United States Patent [19]

Majors

[11] 4,452,016

[45] Jun. 5, 1984

[54] REVERSING WEIGHT FOR VIBRATING FINISHING MACHINES

[75] Inventor: Curtis O. Majors, Cincinnati, Ohio

[73] Assignee: Rosemont Industries, Inc., Cincinnati, Ohio

[21] Appl. No.: 352,766

[22] Filed: Feb. 26, 1982

[51] Int. Cl.[3] ..... B24B 31/06

[52] U.S. Cl. ..... 51/163.2; 74/87

[58] Field of Search ..... 74/61, 87; 51/163.1, 51/163.2

[56] References Cited

U.S. PATENT DOCUMENTS

| | | | |
|---|---|---|---|
| 2,212,818 | 8/1940 | Stoltzfus | 74/87 |
| 2,634,617 | 4/1953 | Dryg | 74/87 |
| 3,358,815 | 12/1967 | Musschoot et al. | 198/220 |
| 3,435,564 | 4/1969 | Bulz | 51/163.2 |
| 3,564,825 | 2/1971 | Gould et al. | 74/87 X |
| 3,606,702 | 9/1971 | Balz | 51/163.2 |
| 3,608,388 | 9/1971 | Huber . | |
| 3,691,409 | 9/1972 | Kobayashi | 310/81 |
| 3,811,231 | 5/1974 | Kobayashi | 51/163.2 |
| 3,844,071 | 10/1974 | Barlett | 51/163.2 |

*Primary Examiner*—Harold D. Whitehead

*Attorney, Agent, or Firm*—Wood, Herron & Evans

[57] ABSTRACT

A vibrating finishing apparatus including an annular tub mounted upon a spring support is disclosed. A drive shaft extends upwardly through the center opening of the tub and is interconnected to the inner wall of the tub. A reversible motor selectively rotates the shaft in either of two directions. The shaft carries a lower eccentric weight and an upper eccentric weight assembly which are offset to create a vibratory movement. The upper weight assembly automatically shifts the angular offset between its center of gravity and that of the lower eccentric weight when the direction of shaft rotation is changed. The upper weight assembly includes a cylindrical housing with two internal baffles at an angle to one another defining a weight chamber partially filled with steel ball weights.

5 Claims, 5 Drawing Figures

REVERSING WEIGHT FOR VIBRATING FINISHING MACHINES

BACKGROUND OF THE INVENTION

The present invention relates to vibrating finishing machines of the type having an annular tub adapted to hold parts being treated and a finishing medium. The tub is vibrated by means of a rotary shaft carrying two eccentric weights. The present invention more particularly relates to the construction of a weight for use in such vibrating finishing machines such that the center of gravity of the weight is automatically displaced relative to the center of gravity of a fixed eccentric weight when the direction of rotation of the shaft is reversed.

PRIOR ART

Vibratory finishing machines of several different types including annular tubs and vertically oriented drive shafts are well known in the prior art. These machines are utilized to perform various operations including grinding, polishing, deburring, drying, burnishing and the like. In such machines the workpiece and finishing material, for example, corn cobs or steel balls, are vibrated in the tub and are caused to follow a helical path around the interior of the tub.

Machines of this type frequently include a discharge chute and a pivoted ramp. The ramp can be shifted from a horizontal position above the lower portion of the tub to an inclined position in which it contacts the bottom of the tub and effectively blocks the tub. When the ramp is so inclined, the workpieces move up the ramp and are discharged through the chute, while the finishing medium is returned to the tub through openings formed in the chute bottom. It is common in such apparatus to cause the workpieces and finishing material to move around the tub in a first direction during the finishing portion of the cycle and to move around the tub in the reverse direction during the discharge portion of the cycle.

In prior art vibrating finishing machines, vibratory motion is produced by means of two spaced eccentric weights carried by the vertical drive shaft. In some machines the position of one of these weights can be manually shifted relative to the other weight by means of a locating pin carried by the weight which can be engaged in any of a series of holes in an underlying support plate. One such arrangement is shown, for example, in U.S. Pat. No. 3,435,564.

It has also been proposed to provide vibrating machines in which at least one of the weights can be shifted hydraulically or by inertia. Typical patents showing such systems are U.S. Pat. Nos. 3,358,815; 3,606,702; 3,608,388; 3,691,409 and 3,844,071. These prior art devices, however, were subject to one or more objections. Specifically, in vibrating machines of the type including an eccentric weight shifted by inertia between first and second stops, there is a tendency for the mechanism to wear out rapidly and to break after periods of usage. Also, such mechanisms create an excessive amount of noise. Machines of the type utilizing motors, hydraulic circuits, and the like, are unduly complicated and expensive and difficult to maintain over protracted periods of use.

OBJECTS OF THE PRESENT INVENTION

The principal object of the present invention is to provide a simple, economical and reliable reversible weight assembly for the drive shaft of a vibrating finishing machine, which weight assembly automatically shifts the position of its center of gravity when the direction of rotation of the shaft is changed.

A further object of the present invention is to provide a novel, reversible weight assembly which is relatively quiet in operation.

SUMMARY OF THE INVENTION

The present invention is predicated upon the concept of providing a drive shaft for vibratory finishing machines which carries a fixed eccentric weight and a novel reversible weight assembly. The reversible weight assembly of the present invention comprises a generally cylindrical housing mounted upon the drive shaft in axially spaced relationship to the eccentric weight. The housing includes a substantially horizontal bottom and two upstanding baffles which extend outwardly from the center portion of the housing to the outer wall thereof. These baffles are angulated with respect to one another to provide a weight chamber which preferably extends over more than 180°. The weight chamber contains a plurality of shiftable weights which in a preferred embodiment are constituted by steel balls. The aggregate weight of these steel balls is appreciable, for example, 20 pounds. However, the balls occupy only a small portion of the volume of this weight chamber.

When the drive shaft is rotated in one direction, the steel balls collect adjacent to one of the baffles. The center of gravity of these balls is offset at a predetermined angle to the fixed eccentric weight. When the direction of shaft rotation is reversed, the balls collect adjacent to the second baffle so that their center of gravity is shifted and a new angle is established between it and the fixed eccentric. This change in angle changes the relationship of the reversible weight to the fixed weight from leading to lagging, or vice versa, and is thereby effective to cause the contents of the tub to progress around the tub in the opposite direction.

In accordance with the present invention, the amplitude of vibration of the tub when the shaft is rotated in both directions is controlled by adjustably positioning the adjustable weight housing relative to the shaft. This is accomplished by mounting the housing upon a plate having a series of holes and inserting a locating pin carried by the housing into the hole corresponding to the desired angular position of the housing.

One advantage of the present reversible weight assembly is that it is of extremely simple construction and is reliable even after protracted periods of operation.

Another advantage of the present reversible weight assembly is that it is relatively quiet in operation compared to the reversing weights presently in commercial use.

A still further advantage of the present invention is that the reversible weight assembly is relatively compact and inexpensive.

These and other objects and advantages of the present invention will be more readily apparent from the following detailed description illustrating a preferred embodiment of the invention.

DETAILED DESCRIPTION OF THE INVENTION

Figure 1:
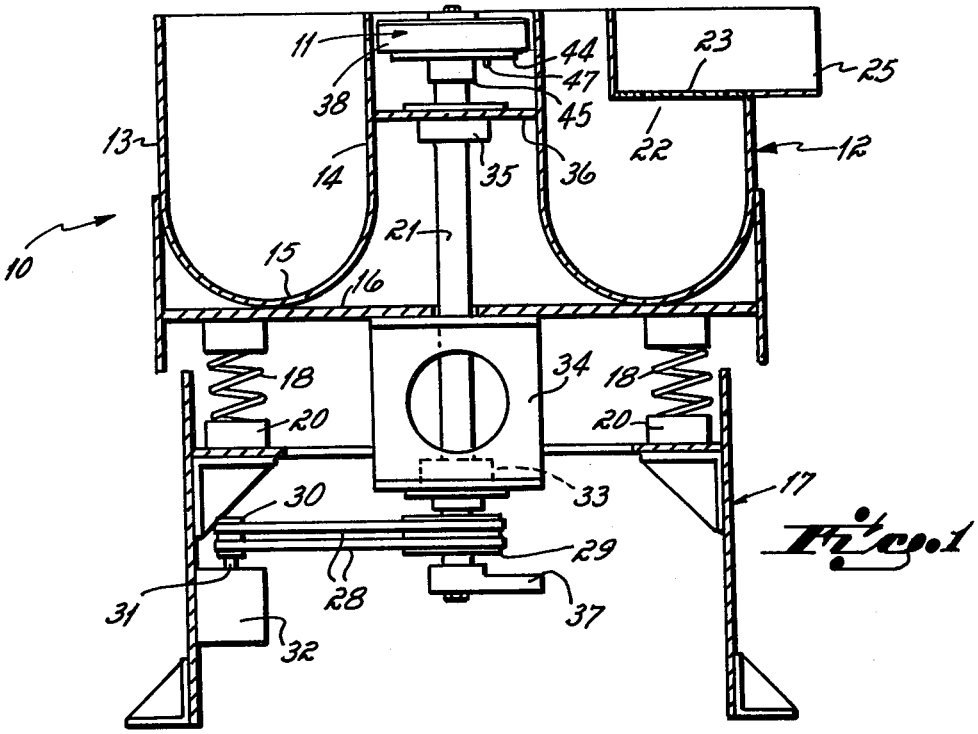
FIG. 1 is an axial cross-sectional view of a finishing machine incorporating a reversing weight of the present invention.

FIG. 1 illustrates the overall construction of a vibrating machine 10 embodying the weight reversing assembly 11 of the present invention. As there shown, the vibrating machine 10 comprises an annular bowl, or tub, 12 which has an open channel cross-section. The tub 12 includes a vertical upstanding outer peripheral wall 13 and an upstanding inner wall 14 interconnected by a curved bottom 15 of generally semi-circular configuration. The tub 12 is mounted upon a horizontal support plate 16 of generally circular configuration.

Support plate 16 is resiliently mounted upon a stationary base 17 by means of a plurality of springs 18. The bottom ends of the springs are supported upon a flange 20 forming part of the base, while the upper ends of the springs support plate 16. In the preferred embodiment, these springs are located along a circle having a center concentric with the center of the tub and with the axis of a vertical drive shaft 21.

Figure 4:
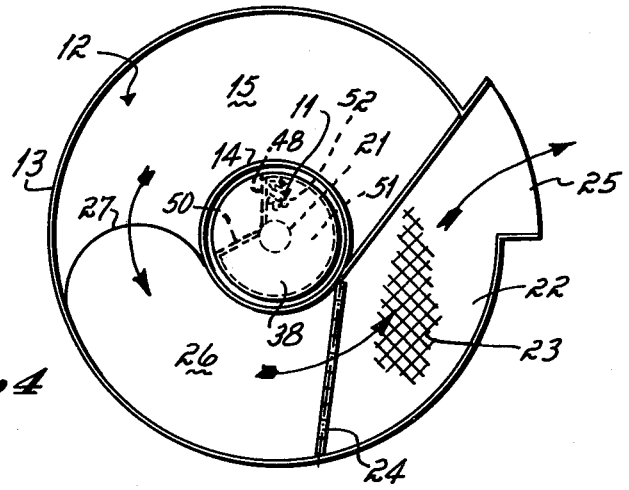
FIG. 4 is a top plan view of the finishing machine during the discharge portion of the cycle.
Figure 5:
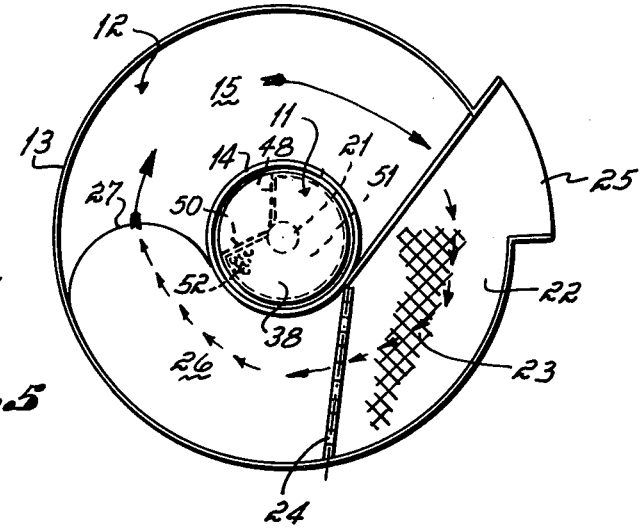
FIG. 5 is a top plan view of the finishing machine during the finishing portion of the cycle.

Tub 12 is provided with a discharge chute and ramp construction. More particularly, as shown in FIGS. 1, 4 and 5, an elevated chute 22 is mounted above a portion of the bowl. This chute includes a horizontal screen 23 which extends from a ramp hinge line 24 to a discharge opening 25. A ramp 26 is hinged to the discharge chute along hinge line 24. The ramp is adapted to swing between a substantially horizontal position, in which it is elevated well above the lower portion of the bowl, and an inclined position, in which it extends downwardly into the bowl with the curved free end 27 of the ramp resting on the bottom 15 of the bowl so that the ramp forms a complete barrier across the bowl. A handle, or hydraulic positioning mechanism (not shown), well known in the art, is provided for raising and lowering the ramp. When the ramp is elevated and parts are circulating in a clockwise direction as viewed in FIG. 5, the parts being treated are free to move repeatedly around bowl 12. However, when the ramp 26 is pivoted downwardly, the parts ride up the ramp and move across the screen 23 to be discharged through opening 25. The finishing medium, e.g., corn cobs, drops back into the bowl through the screen openings.

Drive shaft 21 is effective to vibrate tub 12 in either of two modes to cause the contents of the tub to move in either a clockwise or counterclockwise direction. This shaft carries pulleys 29 at its lower end over which drive belts 28 are trained. These drive belts also pass over pulleys 30 mounted on shaft 31 to drive motor 32. An intermediate portion of shaft 21 is journalled in a bearing 33 carried by cylindrical member 34, this member in turn being rigidly affixed to the lower surface of plate 16.

The upper end of shaft 21 is journalled in a bearing 35 mounted above an opening in transverse plate 36. This plate extends across the center portion of tub member 12 and is welded or otherwise secured to the inner wall 14 of the annular tub member.

The lower end of shaft 21 carries a lower eccentric weight 37 of any conventional configuration. This weight is fixed to shaft 21 and thus has a center of gravity which is located at a predetermined position angularly with respect to the axis of shaft 21.

In accordance with the present invention, a novel reversible weight assembly 11 is carried by the upper portion of the shaft. This weight assembly comprises an annular housing 38 having a horizontal bottom wall 40 and an upstanding circular peripheral wall 41 and a top wall 42 and a tubular inner wall 43. The inner diameter of wall 43 is preferably only slightly larger than the outer diameter of shaft 21 so that the housing 38 can be placed over the shaft with a loose sliding fit. When so positioned, the housing 38 rests upon a support flange 44 carried by a hub 45 secured to shaft 21.

Support flange 44 is provided with a plurality of openings 46 located around the circumference of a circle concentric with shaft 21. Bottom wall 40 carries a depending locating pin 47 which is adapted to be received in any of the openings 46 to position the upper weight assembly in any desired angular relationship to the position of the lower weight 37.

The upper weight assembly further comprises two internal baffles 48 and 50. These baffles extend outwardly from the inner wall 43 to the outer peripheral wall 41 and extend upwardly from the bottom wall 40 to the top wall 43. In a preferred embodiment, baffle 48 is generally tangent at its inner end to inner wall 43. Second baffle 50 is disposed at an obtuse angle of approximately 135° to the first baffle wall, although this angle can be varied in accordance with the design of the specific vibrating machine with which the weight assembly is to be used.

The two baffles, together with the outer walls of the housing, define a weight chamber 51 with the two baffle walls being approximately 225° apart. In accordance with the present invention, a plurality of discrete shiftable weights, preferably in the form of 3/16" steel balls 52, are placed in chamber 51. The total weight of balls 52 in a preferred embodiment is from 18–20 pounds. It is to be understood that balls of a different diameter can be employed and depending upon the design of the specific vibrating machine, a greater or larger total weight of balls can be utilized. In any case, the balls occupy only a small fraction of the volume of chamber 51.

Figure 2:
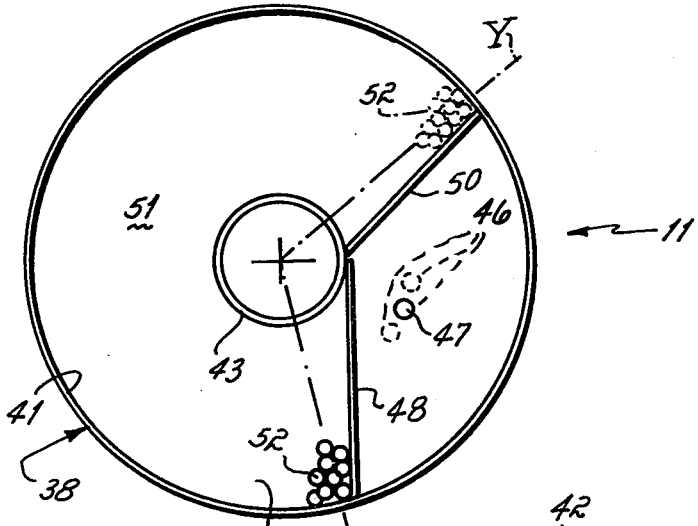
FIG. 2 is a top plan view of the reversing weight.
Figure 3:
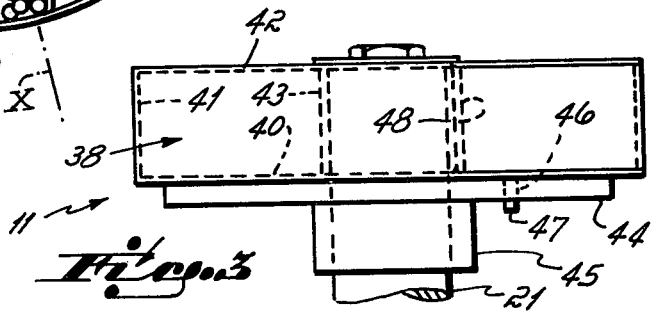
FIG. 3 is a side elevational view of the reversing weight.

As is apparent from FIGS. 2 and 4, when the shaft 21 is rotated in a clockwise direction (looking down on the shaft), the balls tend to collect in a position such that they are piled against first baffle 48. In this position, the center of gravity of the balls would lie along a radius X. This center of gravity makes a predetermined angle with the center of gravity of the lower eccentric weight 37. However, when the drive shaft 21 is rotated in the opposite direction, i.e., counterclockwise (looking downwardly upon the shaft), the steel balls collect in a position (dotted lines in FIG. 2) in which they are piled up against the second baffle 50 and their collective center of gravity is thus shifted so that it lies along a radius Y displaced approximately 200° from the center of gravity of the balls when in abutment with baffle 48. This new center of gravity of the weights during counterclockwise rotation of shaft 21 is thus oriented at a substantially different angle from the center of gravity of lower weight 37 than is the case when the shaft is rotated clockwise. This change in the offset angle of the upper and lower weights is effected automatically upon reversal of the direction of rotation of drive shaft 21 and requires no adjustment whatsoever by the operator.

In use, the angular position of the upper weight assembly is selected by rotating housing 38 until locating pin 47 enters the desired opening 46. The position of housing 38 determines the angle of offset between the center of gravity of the upper weight and lower eccentric weight and, hence, the amplitude of vibration of tub 12. After the upper weight has been positioned, the parts to be treated and a suitable finishing material, such as ground corn cobs, are placed in the bowl 12. Ramp 26 is raised and motor 32 is energized to drive the shaft 21 in a counterclockwise direction as shown in FIG. 5. The ball weights 52 are thus shifted into proximity with baffle 50 and establish a first offset angle with respect to lower weight 37. This offset of the two weights causes the parts within the tub to be vibrated and given a helical motion so that the parts travel in a clockwise direction, passing under hinged ramp 26, which is raised by contact with the parts, so that the parts can travel repeatedly around the bowl.

When it is desired to discharge material from the finisher, ramp 26 is lowered and the direction of rotation of motor 32 is reversed to reverse the direction of rotation of shaft 21. Ihis causes the weights to shift into proximity with the second baffle 48, changing the angle of offset of the center of gravity of these weights relative to the center of gravity of lower weight 37. The angle change reverses the relationship of the upper weight relative to the lower weight from leading to lagging, or vice versa. This in turn reverses the direction of the helical motion imparted to the material within the tub so that the material now moves in a counterclockwise direction as shown in FIG. 4. As a result, hinged ramp 26 drops down into the bowl and the material climbs the hinged ramp onto the screen 23 of the elevated chute 22. The finishing material drops downwardly through the screen and is returned to tub 12, while the finished parts continue to move across the screen 23 and are discharged through opening 25.

The preferred embodiment disclosed in this application has been described by way of example. It will be understood by those skilled in the art that various modifications can be made without departing from the spirit and scope of the invention as defined by the appended claims. For example, motor 32 can be mounted upon member 34 rather than base 17 if desired. There, fore, I desire to be limited only by the scope of the following claims.

Having described my invention, I claim:

1. In a vibratory finishing machine of the type comprising an annular tub for holding workpieces and a finishing medium, a base, spring means mounting said tub upon said base, a motor, a drive shaft disposed vertically on the axis of said tub and means interconnecting said motor and said drive shaft for rotating said drive shaft in either of two directions, means interconnecting said shaft and said tub for imparting vibrational movements from said shaft to said tub, said shaft carrying a first eccentric weight fixedly mounted thereto, the improvement which comprises:

a reversible weight assembly;

said reversible weight assembly comprising a housing including an upstanding peripheral wall and a substantially horizontal bottom wall, means fixedly mounting said housing upon said shaft spaced from said eccentric weight, said housing being connected to said shaft and being rotatable with said shaft when said shaft is driven in either direction;

first and second baffles extending transversely of said housing from a center portion thereof to the peripheral wall, said baffles defining a weight chamber within said housing and a plurality of movable weights disposed within and partially filling said chamber;

said weights being movable across said bottom wall in a direction transverse of said baffles and being collected adjacent to the first of said baffles when the shaft is rotated in one direction to establish a first angular offset between the center of gravity of said shiftable weights and said eccentric weight and being shiftable into proximity with said second baffle when the direction of rotation of the shaft is reversed to establish a second offset angle between the center of gravity of said shiftable weights and the eccentric weight to thereby cause a reversal in direction of movement of the contents of said tub.

2. The apparatus of claim 1 in which the means for securing the reversible weight assembly to the shaft comprises a member secured to said shaft for supporting said housing, said member having a plurality of angularly spaced openings formed therein and a locating pin carried by said housing and adapted to be selectively positioned in one of said openings.

3. The apparatus of claim 1 in which said weights comprise steel balls which fill only a small portion of the volume of said weight chamber.

4. The apparatus of claim 1 in which said baffles extend at an obtuse angle relative to one another and said weight chamber extends over an angle of greater than 180°.

5. The apparatus of claim 4 in which said housing includes a tubular inner wall and a top wall and said baffles extend from said tubular inner wall outwardly to said peripheral wall.

* * * * *